US005595043A

United States Patent [19]

Radigan

[11] Patent Number: 5,595,043

[45] Date of Patent: Jan. 21, 1997

[54] CARTONER WITH SELECTIVELY INTERCHANGEABLE TUCKING AND GLUING MODULES

[75] Inventor: Richard E. Radigan, Cincinnati, Ohio

[73] Assignee: R.A. Jones & Co., Inc., Covington, Ky.

[21] Appl. No.: 338,871

[22] Filed: Nov. 14, 1994

[51] Int. Cl.[6] ..... B65B 7/20; B65B 7/24; B65B 51/02

[52] U.S. Cl. ..... 53/201; 53/376.5; 53/377.4; 53/377.5; 53/377.6

[58] Field of Search ..... 53/201, 376.5, 53/377.2, 377.4, 377.5, 377.6, 284

[56] References Cited

U.S. PATENT DOCUMENTS

| | | | |
|---|---|---|---|
| 2,061,886 | 11/1936 | West | 53/376.5 |
| 2,224,716 | 12/1940 | Anderson | 53/377.4 |
| 2,634,565 | 4/1953 | Currivan | 53/377.5 X |
| 2,933,869 | 4/1960 | Meyer-Jagenberg . | |
| 3,282,021 | 11/1966 | Hartman . | |
| 3,382,777 | 5/1968 | Bivans | 53/377.5 X |
| 3,383,829 | 5/1968 | Duddleston et al. . | |
| 3,462,914 | 8/1969 | Dorfmann . | |
| 3,552,094 | 1/1971 | Dailey et al. . | |
| 3,593,493 | 7/1971 | Alduk . | |
| 3,660,963 | 5/1972 | Sullivan . | |
| 4,441,303 | 4/1984 | Langen | 53/377.5 X |
| 4,565,048 | 1/1986 | Lade . | |
| 4,574,561 | 3/1986 | Dirico | 53/377.4 |
| 4,894,104 | 1/1990 | Hemus | 53/376.5 X |
| 5,060,451 | 10/1991 | DeMay et al. | 53/201 |
| 5,131,208 | 7/1992 | Paul et al. | 53/376.5 |
| 5,341,621 | 8/1994 | Martelli | 53/377.5 |

*Primary Examiner*—Horace M. Culver
*Attorney, Agent, or Firm*—Wood, Herron & Evans, P.L.L.

[57] ABSTRACT

A cartoner for loading products into cartons and for sealing the ends of product cartons as the cartons move along a carton path therein comprises a tuck module located at a position on the cartoner along the carton path for engaging an end flap of the product carton and tucking a portion of the end flap into the carton to seal the carton end and a glue module, selectively interchangeable with the tuck module at the position along the carton path, for engaging an end flap of a product carton and gluing the end flap to a portion of the carton such that a single cartoner may be used to seal cartons by selectively tucking or gluing the end flaps.

38 Claims, 7 Drawing Sheets

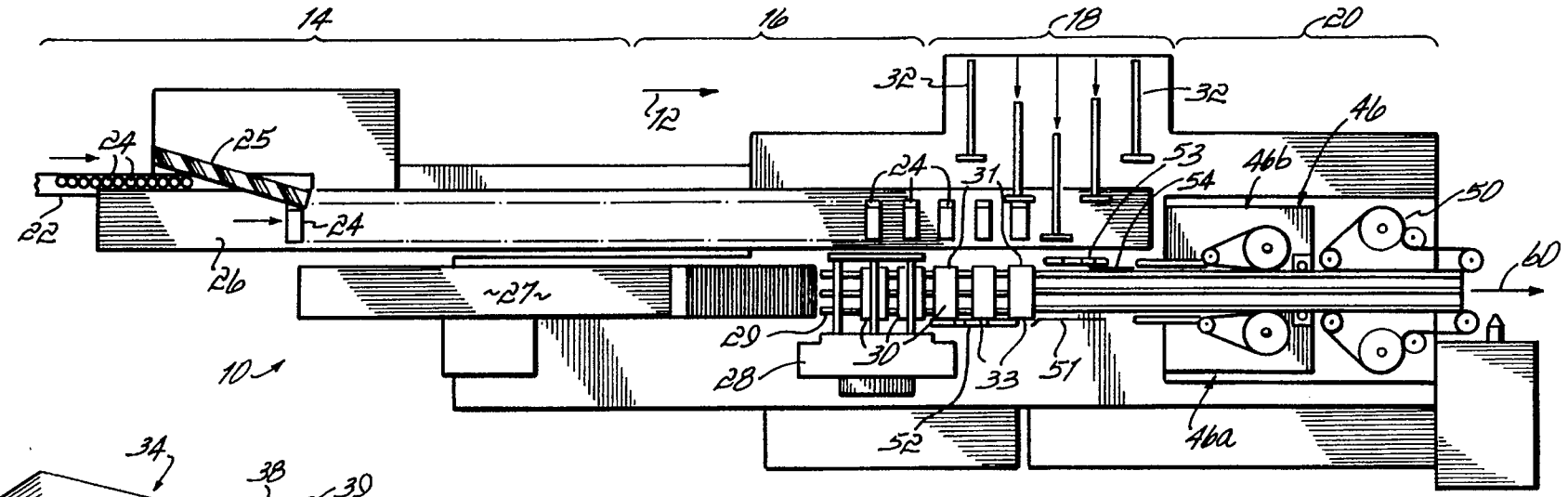
FIG. IA
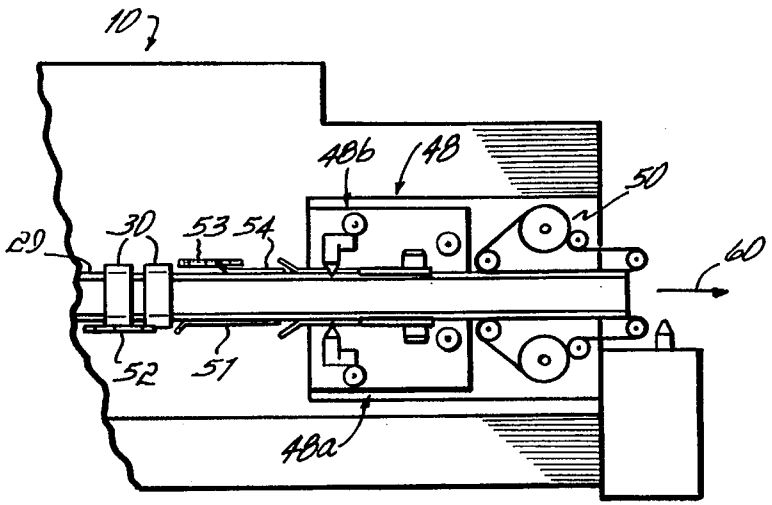
FIG. IB
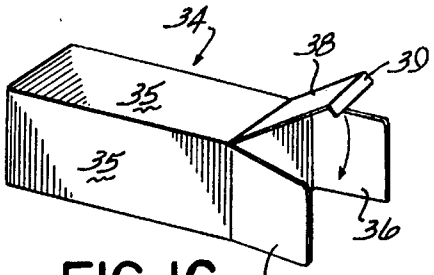
FIG. IC
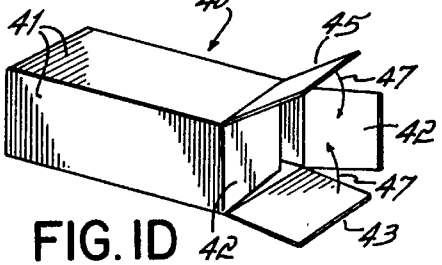
FIG. ID

CARTONER WITH SELECTIVELY INTERCHANGEABLE TUCKING AND GLUING MODULES

FIELD OF THE INVENTION

The present invention relates to cartoners for enclosing product loads in cartons, and particularly to cartoners which seal the loads in the cartons by tucking or gluing the carton end flaps with respect to the carton.

BACKGROUND OF THE INVENTION

A variety of different consumer products are packaged and shipped within cartons, such as paper board cartons. For example, paper board cartons are particularly prevalent for shipping consumer goods in the pharmaceutical, health care and cosmetic industries. Such paper board cartons are generally rectangular in shape and include four side walls and a plurality of end flaps at each end for closing and sealing the carton with the product load therein.

When packaging such goods in cartons, a cartoning apparatus or cartoner is utilized which handles a variety of different packaging tasks. For example, a cartoner usually conveys individual product loads, such as aspirin bottles, adjacent to erected, open product cartons. A variety of different cartoner mechanisms insure that the end flaps of the erected product cartons are open so that the product loads may be inserted therein. The cartoner also usually includes a product loading mechanism which engages the individual product loads and pushes, drops or otherwise presents the product loads into the open cartons. Next, the cartoner closes and seals the end flaps of the carton to seal the product carton and present a complete product ready for shipping.

There are several ways in which a product carton might be closed and sealed. One way is to tuck a portion of an end flap into the end of the carton. Another technique utilized to seal a carton is to glue one of the end flaps to an overlapping end flap, such as with a hot melt adhesive glue. Additional end flaps, such as carton dust flaps lie beneath the sealed end flaps and are closed prior to sealing the cartons. In some currently available cartoners, the product cartons are sealed either exclusively by gluing or exclusively by tucking. Therefore, if a manufacturing or packaging facility desires to utilize cartons which are sealed by gluing for some products and cartons which are sealed by tucking for other products, the facility would usually need to purchase and maintain two separate cartoners. As may be appreciated, two separate cartoners are expensive to purchase and maintain and require valuable factory floor space even though only one of the cartoners might be operating at any given time. However, multiple cartoners may be necessary in order for a facility to handle a variety of packaging tasks.

Cartoners are available which provide both gluing and tucking to seal cartons depending upon the cartoner mode of operation that is chosen. However, such cartoners include permanent mechanisms for both tucking and gluing which are strung out along the length of the cartoner, and therefore, along the production line. These cartoners thus have an extended machine footprint utilizing valuable factory floor space.

One alternative to multiple cartoners has been to convert an existing cartoner which glues end flaps to seal a carton to one which tucks end flaps to seal the carton, or vice versa. However, such conversions have traditionally been permanent conversions and are time consuming and expensive, because an intricate section of the cartoner must be overhauled and retrofitted in order to accommodate the different carton-sealing techniques. In effect the cartoner is rebuilt in the new application. Furthermore, conversions result in an inefficient packaging line, as the line will remain inoperable during the long conversion period, thereby reducing the cost effectiveness of the cartoner.

Accordingly, there is a need for a cartoner which is capable of efficiently sealing a loaded product carton selectively by gluing and tucking with minimal change over time and expense.

SUMMARY OF THE INVENTION

To these ends, a cartoner in accordance with the principles of the present invention, is capable of sealing the ends of product cartons selectively by either tucking or gluing the end flaps of the cartons as the cartons move along a carton path. The cartoner includes a tuck module which is located at a position on the carton path to engage a carton and tuck a portion of an end flap into the carton end to seal the carton. A glue module which is capable of engaging a carton and gluing two end flaps together to seal the carton, is selectively interchangeable with the tuck module at the same position along the carton path. The modules may be readily interchanged without modification to the rest of the cartoner structure, and therefore, a single cartoner may be utilized to seal cartons by one of selectively tucking or gluing the end flaps. The modules may be quickly and easily interchanged and are adjustable so that the cartoner can handle a variety of different cartoning applications.

In one aspect of the invention, each tuck and glue module comprises a pair of opposing tucking and gluing mechanisms, respectively, which are positioned on either side of a carton path at a predetermined position along the path. Each modular mechanism closes and seals one of the opposing ends of the product carton. Furthermore, each sealing mechanism is independently operable from the other mechanism and is interchangeable with a different sealing mechanism on a respective side of the carton path. Therefore, in another aspect of the invention, the cartoner may be configured, using the interchangeable modular mechanisms, to seal one end of the carton by tucking and the opposite end of the carton by gluing. In still another aspect of the invention, one end of the carton might be pre-sealed such that only one tucking or gluing mechanism is necessary for each interchangeable module.

In an embodiment of the invention, each tucking mechanism comprises an upper carton rail which engages the top of the carton and maintains it in a fully rectangular and open position. A lower carton rail engages the bottom of the carton and maintains additional carton end flaps, such as dust flaps, in a closed position. The modules of the present invention are configured to receive the cartons with the dust flaps already in a closed position. As the carton progresses through the module, an end flap guide engages the end flap and directs the end flap toward the end of the carton and toward a closed position. During progression of the end flap toward the carton, the end flap guide forces a portion of the end flap over a flap folding guide which folds a portion of the end flap to create a tuck flap which is angled with respect to the end flap. Progressing along the module, a tuck flap guide engages the tuck flap and further folds it over the folding guide. As the end flap is directed to a closed position, a hinge guide presses against the hinge of the end flap to insure smooth hinging of the flap and to further direct the end flap to a closed position.

When the tuck flap has been completely folded, a rotating belt, angled with respect to the carton path, gradually engages the end flap and directs or shoves the end flap against the end of the carton as the carton progresses through the module thereby tucking the tuck flap into the carton end. Sequentially following the belt in the carton path, a locking roller rolls against the end flap proximate the tuck flap and further insures that the tuck flap is properly tucked into the end of the carton, whereupon the sealed carton exits the module. The individual modular tucking mechanisms of the tuck module are laterally movable away from each other so that the module may accommodate cartons having different lengths. Furthermore, the folding guide is movable inwardly and outwardly perpendicular to the carton path to accommodate end flaps of different lengths, while the upper carton rail, the hinge guide and the end flap guide are all vertically movable with respect to the carton path to accommodate cartons of different heights.

A carton to be sealed by gluing generally includes four flaps, and as discussed above, opposing dust flaps are held closed prior to the carton entering the gluing module. In one embodiment of the invention, each gluing mechanism of the gluing module comprises an end flap guide which captures one of the end flaps of the carton and guides the end flap to a closed position. At the time that the one end flap is closed, an upper end flap guide arm engages the opposing end flap and lifts it upwardly and out of the way of the carton end. An upper carton rail maintains the carton in a rectangular and fully open orientation. The end flaps are maintained in their respective positions by the end flap guides and the carton proceeds past an adhesive or glue applicator, such as a glue gun. An optical device or electronic eye senses the presence of the carton and actuates the glue gun to apply glue to the closed end flap. As the carton progresses along the carton path through the gluing mechanism, a lower carton rail maintains the closed flaps in position and the carton moves past an end flap closing device or closer which is angled on a vertical slant with respect to the carton path. The closer engages the unclosed end flap and gradually directs the end flap to overlap the opposing end flap and the glue and seal the carton. The completely sealed carton then progresses past a compression plate which compresses the overlapped end flaps and glue together to create a stronger seal before the carton progresses out of the gluing module.

In a preferred embodiment, the end flap closer is an elongated angled arm which remains stationary, and movement of the carton past the arm provides the closing action of the end flap. However, should the conveyance of cartons through the gluing module stop, the cartoner of the present invention is operable to pivot the closer arm downwardly to close and seal any cartons to which glue has already been applied. Thus, the cartoner of the invention prevents loss of cartons when the cartoning cycle is stopped.

Similar to the tuck module, the opposing gluing mechanisms of the gluing module are laterally moveable away from each other to each side of the carton path to accommodate cartons of various lengths. Moreover, the glue gun, upper carton rail and end flap guides are all vertically adjustable to accommodate cartons with various heights. Furthermore, the angle of the closer arm with respect to the carton path is adjustable to accommodate a variety of carton heights.

In an embodiment of the present invention, the components of the tucking and gluing mechanisms are arranged on mounting plates. The cartoner includes a support platform on the carton path with upstanding alignment pins which are received by recesses in the mounting plates to secure the mechanisms on the cartoner and to align the module with the carton path.

The present invention thereby presents a cartoner which selectively seals cartons by either tucking or gluing the end flaps into the carton. The tucking and gluing modules and the mechanisms of the modules are easily and efficiently interchanged to handle a variety of carton seal techniques and a variety of differently sized cartons thereby eliminating the need for multiple cartoning machines and expensive and time consuming conversions. Further, the cartoners utilizing the interchangeable modules of the present invention has a small factory footprint saving valuable floor space.

The above advantages and other objectives and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

FIG. 1A is a top plan view of a cartoner using the interchangeable tuck module of the present invention;

FIG. 1B is a portion of the cartoner FIG. 1A incorporating the interchangeable glue module of the present invention;

FIG. 1C is a perspective view of a carton utilized with the interchangeable tuck module of the invention;

FIG. 1D is a perspective view of a carton utilized with the interchangeable glue module of the invention;

DETAILED DESCRIPTION OF DRAWINGS

Figure 2:
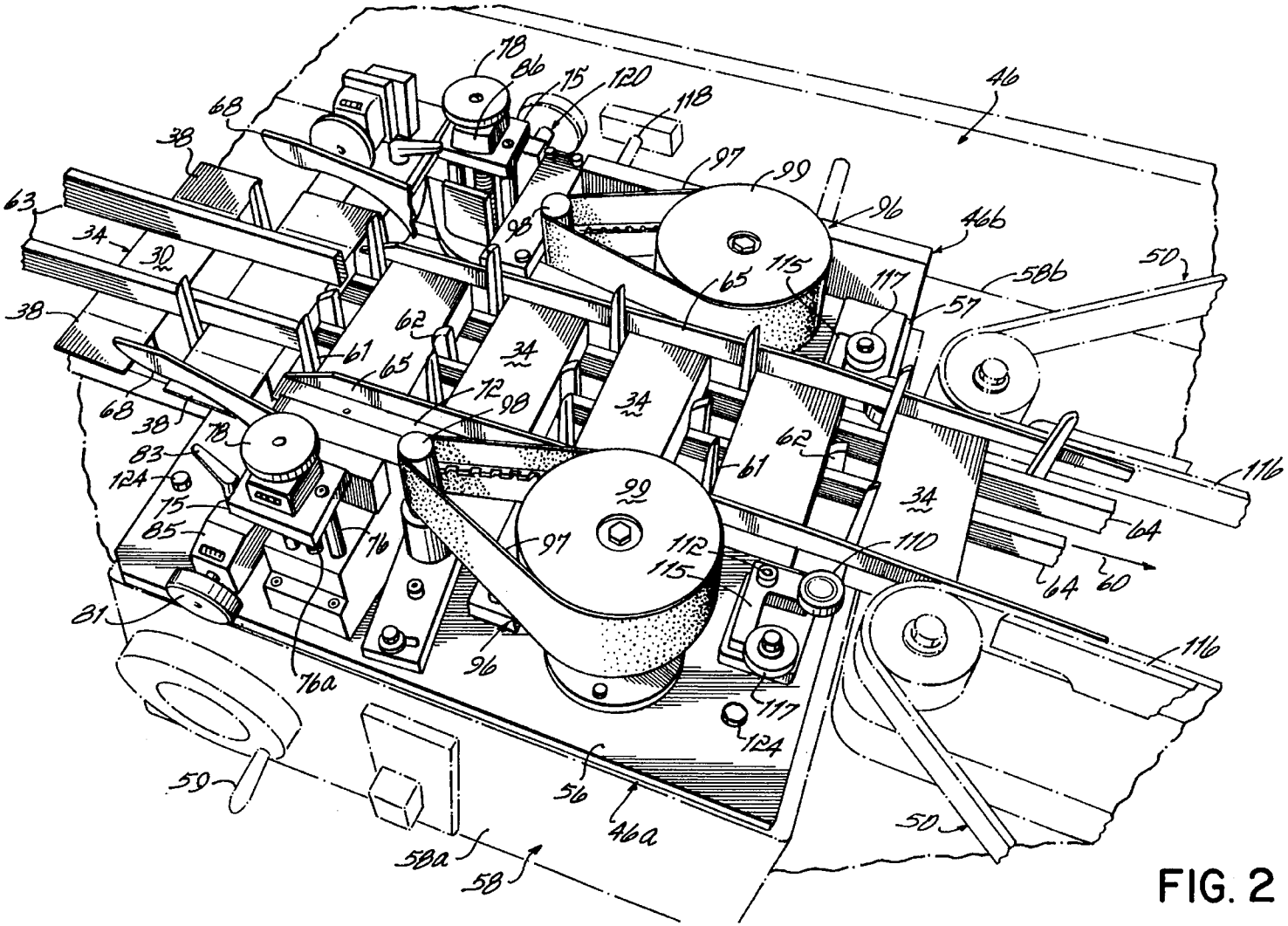
FIG. 2 is a top perspective view of the interchangeable tuck module of the invention.

FIG. 1A is a top-plan view of a cartoning apparatus or cartoner utilizing the selectively interchangeable tuck and glue modules of the present invention. Cartoner 10 is generally divided into four sections which perform different carton loading, transferring, and sealing tasks as a carton moves along a carton path in a machine direction indicated by reference arrow 12. Cartoner 10 has a product transfer section 14, a carton feeding and opening section 16, a product loading section 18, and a carton closing and discharge section 20 where the selectively interchangeable tuck and glue modules of the present invention are utilized.

Product transfer section 14 includes a bulk product conveyor 22 which conveys bulk product 24, such as bottles of aspirin, although other suitable products may also be cartoned in a similar fashion as described herein. The aspirin bottles 24 are engaged by a worm screw separator 25 which turns the bottles on their sides after separating them from each other and transports them to another conveyor 26. The bottles might be placed in product buckets (not shown) on conveyor 26. Flat, unassembled cartons are loaded into a carton magazine 27, and the bottles 24 and cartons 27 are transferred into the carton feeding and opening section 16. In section 16, the carton magazine 27 cooperates with an Orbi-Trak® carton feed unit available from R. A. Jones & Co., Inc. of Erlanger, Ky. as described in U.S. Pat. No. 4,518,301, filed Jul. 6, 1982 and entitled ORBITAL FEEDER, and U.S. Pat. No. 4,596,545, filed Feb. 7, 1985 and also entitled ORBITAL FEEDER, both patents being incorporated herein by reference. The Orbi-Trak® feed unit 28 erects the cartons 30 and places them on another conveyor 29 to be conveyed adjacent the aspirin bottles 24. As both individual cartons 30 and aspirin bottles 24 enter the product loading section 18, the bottles 24 are engaged by extensible plungers 32 of a loading mechanism, such as a barrel loading mechanism, which push the individual bottles 24 into respective adjacent cartons 30. Each carton 30 has a load end 31 which should be maintained open to receive the aspirin bottle 24 and a non-load end 33 which may be at least partially closed when the bottles 24 are loaded.

Referring to FIG. 1C, a tuck-type carton 34 for use with the tuck module 46 of the invention is shown and is generally rectangular having four opposing side panels 35, dust flaps 36 and an end flap 38 with tuck flap 39 which is inserted into the end of the carton 34 to seal the carton as described herein below. Alternatively, FIG. 1D illustrates a typical glue-type carton 40 for use with the glue module 48 of the invention with four side panels 41, dust flaps 42, and opposing end panels 43 and 45. After the dust flaps 42 are closed, the end panels 43, 45 are closed in the direction of the respective arrows 47 such that flap 45 overlaps flap 43. A bead of glue, such as a hot-melt adhesive, is applied to the lower end flap 43 and the upper end flap 45 is pressed against the bead and lower end flap 45 to seal the carton 40. The cartons 30 of FIG. 1 enter the interchangeable modules of the invention lying on their sides with their longitudinal axis perpendicular the carton path 60 and moving in a machine direction 12. For use in the embodiment of the invention shown in the figures, the carton end flaps 38 and 43, 45 are oriented to hinge upwardly and downwardly while the dust flaps 36 and 42 hinge inwardly and outwardly from the sides of the cartons as illustrated in FIGS. 1C and 1D. Reference numeral 30 is used herein to refer generally to product cartons, while the cartons used in the tuck and glue modules 46, 48 are specifically designated as 34 and 40, respectively.

Cartoner 10 of FIG. 1A includes the interchangeable tuck module 46 of the invention which seals a carton, such as carton 34 shown in FIG. 1C. The cartoner of FIG. 1B utilizes the interchangeable glue module 48 of the invention and is capable of sealing a carton such as carton 40 of FIG. 1D. Glue module 48 may be selectively interchanged with tuck module 46 at the same position in the cartoner 10 without any modification to the other sections and mechanisms of the cartoner. Both the tuck module 46 and glue module 48 are described in greater detail hereinbelow in accordance with the principles of the present invention. After the cartons are sealed in the carton closing and discharge section 20 by one of the modules 46, 48, a discharge speed belt system 50 engages the cartons 30 and rapidly moves them out of the cartoner 10 to be further processed.

The tuck module 46 and glue module 48 of the present invention close and seal end flap 38 and end flaps 43, 45, respectively, as the cartons 34, 40 pass through section 20 of the cartoner 10. Before entering either of the modules, 46, 48, the dust flaps 36 and 42 of cartons 34 and 40, respectively, are preferably closed, and therefore, cartoner 10 is configured to place the dust flaps in a closed position. Referring again to FIG. 1 A, a star wheel and guide system is utilized to close both dust flaps. The non-load end 33 of the carton 30 may be closed prior to loading the carton 30. The leading dust flap of the carton 30 is captured by a rail 51 and pushed closed as the cartons moves along path 60. The trailing dust flap of the carton must be pushed shut before engaging the rail 51 so that the dust flaps are maintained in a closed and overlapped position as the cartons 30 enter the respective tuck or glue modules 46, 48. To that end, a star wheel 52 or other mechanism is utilized to push the trailing flap closed right before the carton passes guide 51. The star wheel 52 rotates in timed sequence with the movement of the cartons and has a series of projecting arms (not shown) which engage the trailing dust flaps. The trailing dust flaps are pushed closed, and the overlapped dust flaps 36 and 42 progress to guide 51 prior to entering a module 34, 40, respectively. After the product 24 has been loaded, a similar star wheel 53 and dust flap guide 54 close the dust flaps of the load end 31 of the carton so that all dust flaps are closed prior to the carton 30 being sealed.

FIG. 2 is a more detailed view of an embodiment of the tuck module 46 of the invention. Tuck module 46 includes two adjacent tucking mechanisms **46*a* and 46*b* which are similarly operable along a carton path 60 to close the opposing ends of the cartons 34 and to seal the ends by tucking a portion of the respective end flaps into each carton. The components of each mechanism are supported by mounting plates 56, 57 which sit on a module support platform 58 on either side of the carton path 60. Module support platform 58 lies transverse to carton path 60 and is preferably divided into two sections 58*a* and 58*b*, one on each side of path 60, which are separable and are operable to be moved on tracks 118 away from each other such as by turning hand wheel 59 and screw 120 as described below (see FIG. 3). Module support platform 58 may be separated to move the individual tucking mechanisms 46*a* and 46*b* away from each other so that the tucking module 46 may accommodate cartons 34** of different lengths.

As discussed above and illustrated in the Figures, the cartons 30 pass through the modules 46, 48 on their sides so that separating the individual mechanisms **46*a*, 46*b* on path 60 will yield a module 46 which receives and processes a longer carton. The individual cartons 34 are moved along carton path 60 by two trailing lugs or upstanding pushers 61 which push against a rear side of the cartons. The cartons are held at the forward side by a stop mechanism or leading lug 62. The trailing lugs 61 and leading lugs 62 are operably coupled to a conveying mechanism, such as a chain 63, for moving the cartons along path 60 through tuck module 46. Prior to entering the module, the upper sides of the cartons 34 are held by upper rails 63 while the lower sides of the cartons 34 are supported by lower rails 64. As the cartons 30 enter the tuck module 46, the end flaps 38 are in an upward and open position away from the ends of the cartons. As described in greater detail hereinbelow, the end flap 38 is engaged by a series of guides, as carton 34 travels through module 46, which direct the end flap 38 and fold a portion of the end flap into a tuck flap and subsequently shove the tuck flap into the end of the carton 34** to seal the carton.

Figure 3:
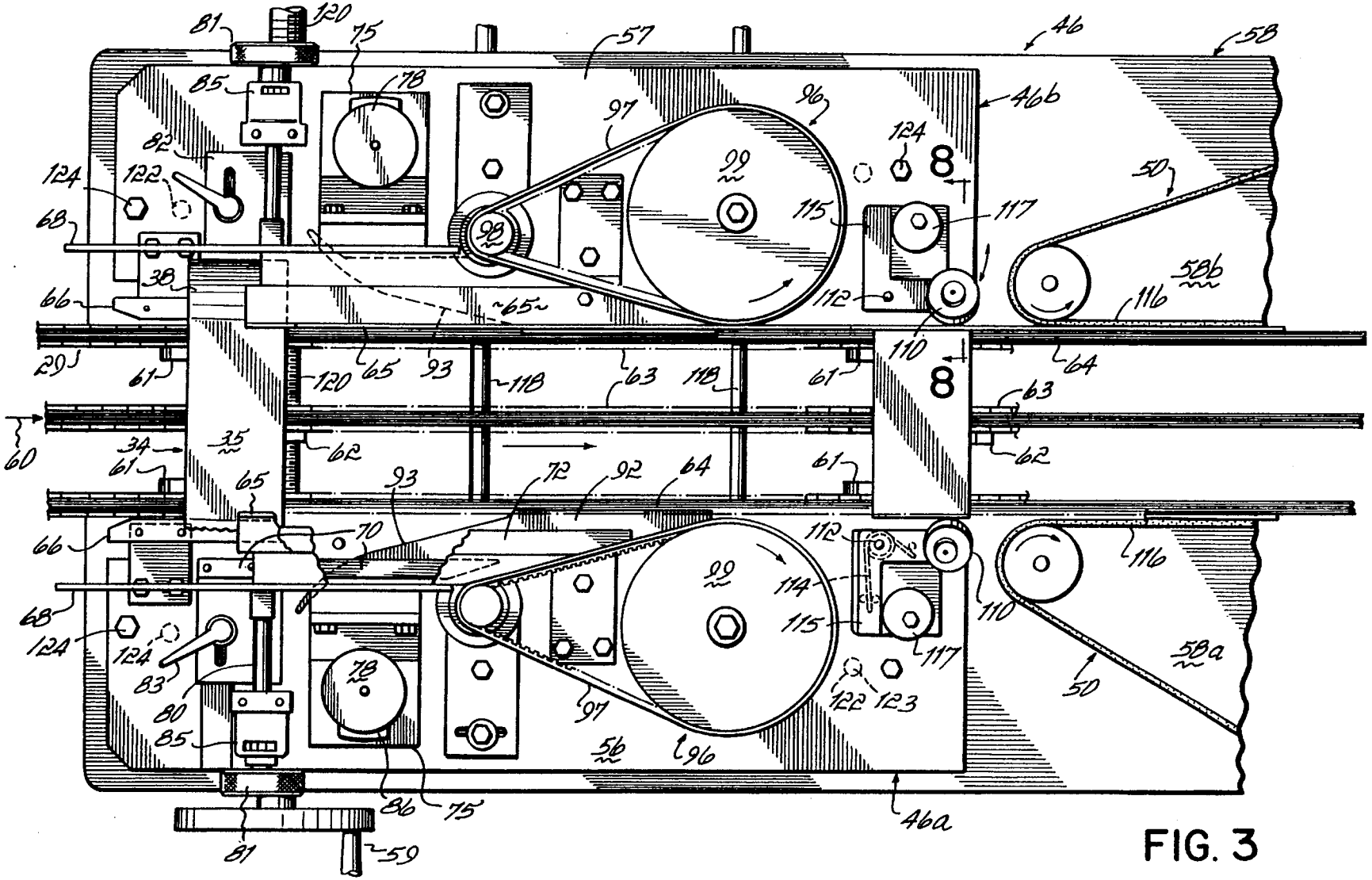
FIG. 3 is a top view of the interchangeable tuck module of FIG. 2.
Figure 4:
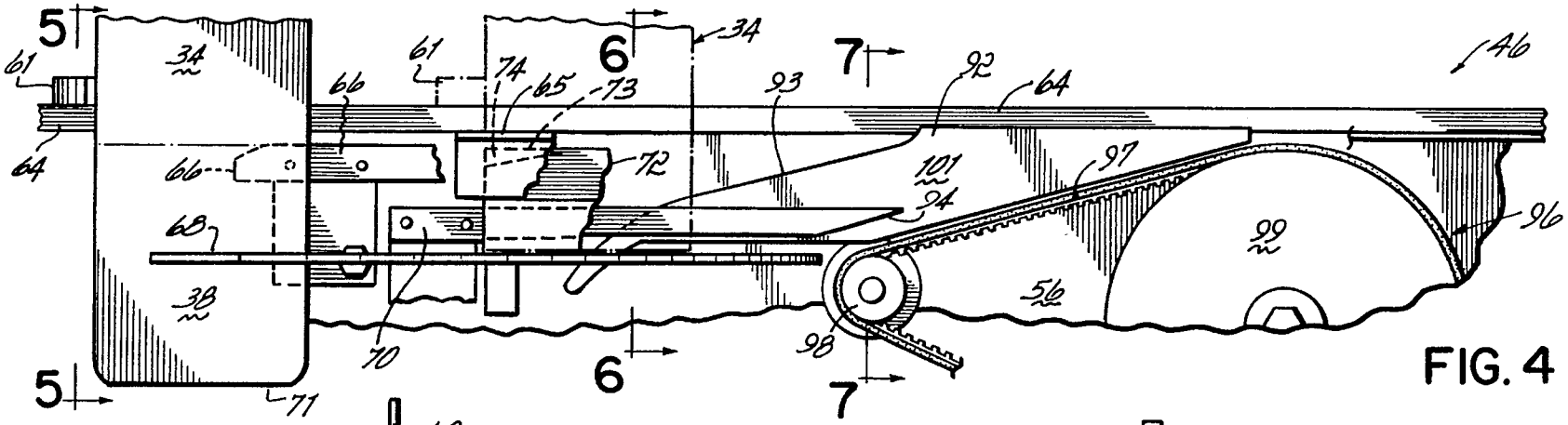
FIG. 4 is a detailed top view, partially cut-away, of a tucking mechanism of the interchangeable tuck module FIG. 2.
Figure 5:
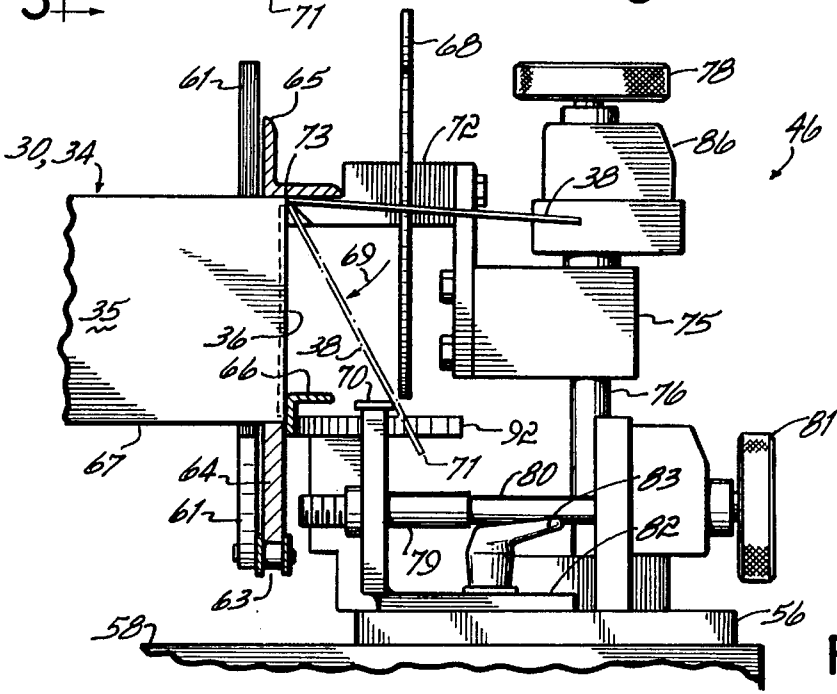
FIG. 5 is a cross-section view of the tucking mechanism along lines 5—5 of FIG. 4.

The operation and construction of tuck module 46 will now be described by describing the operation of one of the tucking mechanisms 46*a*. It should be understood that mechanism 46*b* is constructed and operates generally identically to mechanism 46*a*, except the various guides, rails and other elements are arranged to close and seal an opposite end of carton 34. Referring now to FIG. 3, carton 34 enters module 46 and is held down proximate an end thereof by an upper carton rail 65 (see FIG. 5). As mentioned above, the dust flaps 36 of carton 34 are closed before the carton enters tuck module 46. The dust flaps 36 are maintained in a closed position within module 46 by a lower rail 66 also at the end of the carton 34 and proximate the bottom side 67 of the carton 34. Referring to FIGS. 4 and 5, as the carton 34 progresses along the carton path 60 through module 46, the end flap 38 is engaged by an end flap guide 68 which directs the end flap downwardly toward the end of carton 34 which is to be sealed. The end flap guide 68 has an arcuate leading edge which slopes downwardly (see FIG. 2) to gradually direct end panel 38 in a downward direction as illustrated by arrow 69 in FIG. 5. As carton 34 progresses along carton path 60, the downwardly moving end panel 38 engages a flap folding guide 70 proximate the loose or non-hinged end 71 of the end flap 38. End flap guide 68 begins to fold the end flap end 71 over folding guide 70 to create a tuck flap 39 (see FIG. 6) as described further below. Sequentially thereafter, along the carton path 60, the carton 34 is engaged by a hinge guide 72 which has a sharp angled edge 73 which presses against the hinge 77 of end flap 38 to encourage a smooth downward motion of the end flap. The sharp edge 73 preferably includes an angled transition portion 74 at the leading edge thereof (see FIG. 4) which angles inwardly and upwardly with respect to edge 73 to smoothly capture the hinge 77 as the carton 34 moves somewhat rapidly through mechanism 46*a*.

As illustrated in FIG. 5, the end flap guide 68, hinge guide 72 and upper carton rail 65 are preferably coupled together and are supported by a support 75 which is vertically moveable on parallel shafts 76 by adjustment screw 76*a* which may be turned by a hand wheel 78 (see FIG. 2). In that way, the height of the end flap guide 68, hinge guide 72, and upper carton rail 65 may be adjusted to accommodate cartons of various different heights. Similarly, flap folding guide 70 is coupled to a threaded collar 79 which, in turn, is coupled to an adjustment screw 80 which may be turned by hand wheel 81. Folding guide 70 is horizontally movable toward and away from the end of carton 34 to vary the position on the end flap 38 where the tuck flap is formed to further adjust the tucking mechanism for 46*a* cartons of various lengths. Folding guide 70 will usually be moved in conjunction with end flap guide 68. The folding guide 70 is further guided by a slotted plate 82 (see FIG. 3), and a handle 83 may be tightened down on plate 82 to hold folding guide 70 in place once it has been properly adjusted. Both hand wheels 81, 78 are provided with calibrated numerical readouts 85, 86, respectively, to determine the exact positioning of the various guides.

Figure 6:
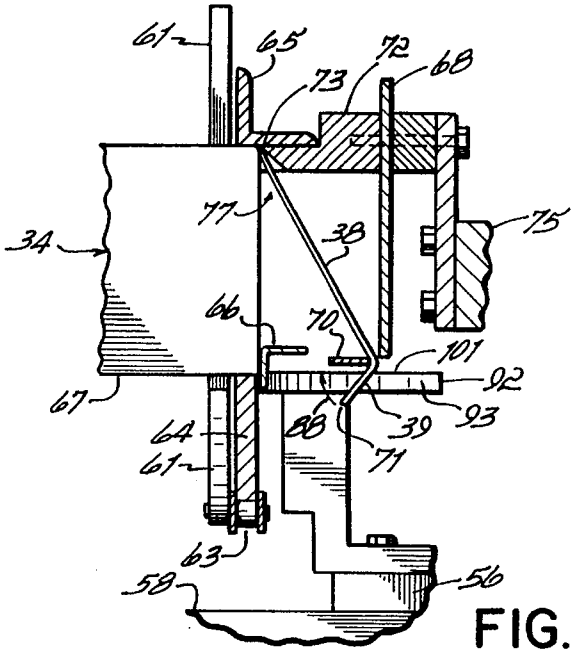
FIG. 6 is a cross-section view of the tucking mechanism along lines 6—6 of FIG. 4.

Referring now to FIG. 6 as carton 34 progresses through tucking mechanism 46*a*, the free end 71 of end flap 38 is folded over folding guide 70 in the direction of arrow 88 so that a portion of end flap 38 forms tuck flap 39. As the carton 34 progresses down carton path 60, the tuck flap 39 engages a lower tuck flap guide 92 which further folds the tuck flap 39 over folding guide 70. Tuck flap guide 92 is generally planar and is oriented horizontally.

As illustrated in FIGS. 3 and 4, tuck flap guide 92 has a sloping leading edge 93 which curves inwardly to the carton path 60 and gradually engages the tuck flap 39 and further folds the tuck flap 39 so that it is sandwiched between folding guide 70 and tuck flap guide 92 which are positioned in generally horizontally spaced planes (see FIG. 6).

Figure 7:
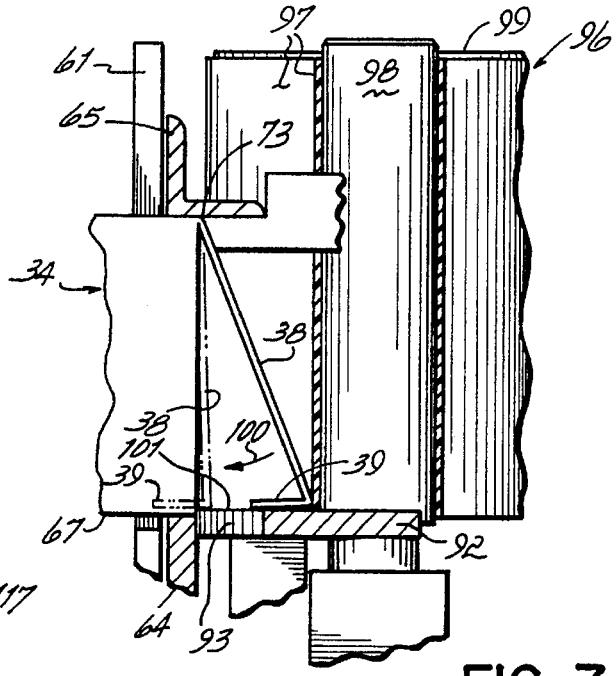
FIG. 7 is a cross-section view of the tucking mechanism along lines 7—7 of FIG. 4.
Figure 8:
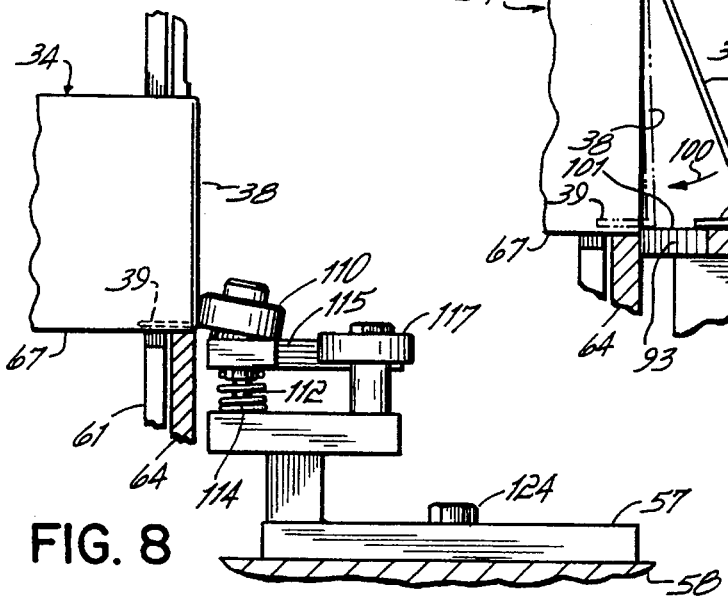
FIG. 8 is a cross-section view of the tucking mechanism along lines 8—8 of FIG. 3.

The carton 34 progresses with the tuck flap 39 sandwiched between the folding guide 70 and tuck flap guide 92 until the carton reaches a belt closing mechanism 96 at which position the carton 34 passes off the end 94 of the folding guide 70 (see FIG. 4). Thereafter, the tuck flap 39 rides on a top surface 101 of the tuck flap guide 92 as illustrated FIG. 7. Belt closing mechanism 96 includes a rotating belt 97 which is driven by a drive roller 99 around a guide roller 98 and is driven such that the belt 97 moves predominantly in the direction of the carton path 60 adjacent the carton end flap 38. As illustrated in FIGS. 3 and 4, the section of the rotating belt 97 which is adjacent to end flap 38 is angled inwardly toward the carton path 60 and the carton ends so that as the cartons 34 move along the carton path, belt 97 directs or shoves the end flaps 38 in the direction of arrow 100 thereby tucking the tuck flap 39 into the end of the carton as shown in phantom in FIG. 7. As the carton proceeds past drive roller 99, the belt 97 is directly adjacent end flap 38 such that tuck flap 39 is fully tucked into carton 34. The rotation of belt 97 in the direction of the carton path 60 insures smooth closing of the end flap 38 and tucking of tuck flap 39 as the carton 34 proceeds along the path. Belt 97 is preferably made to rotate at a speed relative to the speed of the carton conveyor in order to achieve smooth tucking of the end flap 38.

Upon proceeding past the belt closing mechanism 96 of the tucking mechanism 46*a*, the carton 34 engages a locking roller 110 which is positioned at the end of the carton proximate the lower side 67 and the tucked tuck flap 39. Locking roller 110 rotates about axle 112 on an L-shaped arm 115 and is spring biased by spring 114 against the end flap 38. Locking roller 110 has eccentric locking cam 117 which will ensure that the proper pressure is applied to the end of the flap. Adjustment of roller 110 is accomplished by rotating cam 117. Locking roller 110 rolls across end flap 38 and ensures that tuck flap 39 if fully inserted into the end of carton so that the carton is securely sealed. Upon passing the locking rollers 110 the carton proceeds out of module 46 to the discharge belt system 50 which includes high speed belts 116 rotating in the direction of the carton path 60. Thereby, a product carton 34 is sealed at both ends by a tucking procedure, and the sealed carton is ready to be further packaged and shipped upon exiting the cartoner 10.

Referring again to FIG. 3, all of the components of each tucking mechanism 46*a*, 46*b* are arranged on respective mounting plates 56 and 57 which, in runt, are supported by module support platform 58 which has to separate sections 58*a* and 58*b* which are movably slidable on tracks 118. The module support platform 58*a*, 58*b* may be spread apart or moved together along the carton path 60 by rotating the hand wheel 59 which rotates an adjustment screw 120. In that way, the trucking mechanisms 46*a*, 46*b* may be moved apart or together to accommodate cartons of different length. Each mounting plate 56, 57 preferably includes a plurality of alignment recesses or holes 122 which receive upstanding alignment pins 123 on the respective platform sections 51*a*, 58*b*. The tuck module 46 is interchanged, such as with glue module 48, described herein below, by lifting mounting plates 56, 57 off of the respective module support platform 58*a*, 58*b*. When the tuck module 46 is placed on module support platform 58, the alignments holes 122 insure that each tucking mechanism 46*a*, 46*b* is properly spaced and aligned along the carton path 60 and with respect to each other to insure efficient tucking of the carton end panels. Once mounted and aligned on the cartoner 10, the mounting plates 56 and 57 are held in place by bolts 124 or other suitable fasteners.

Figure 9:
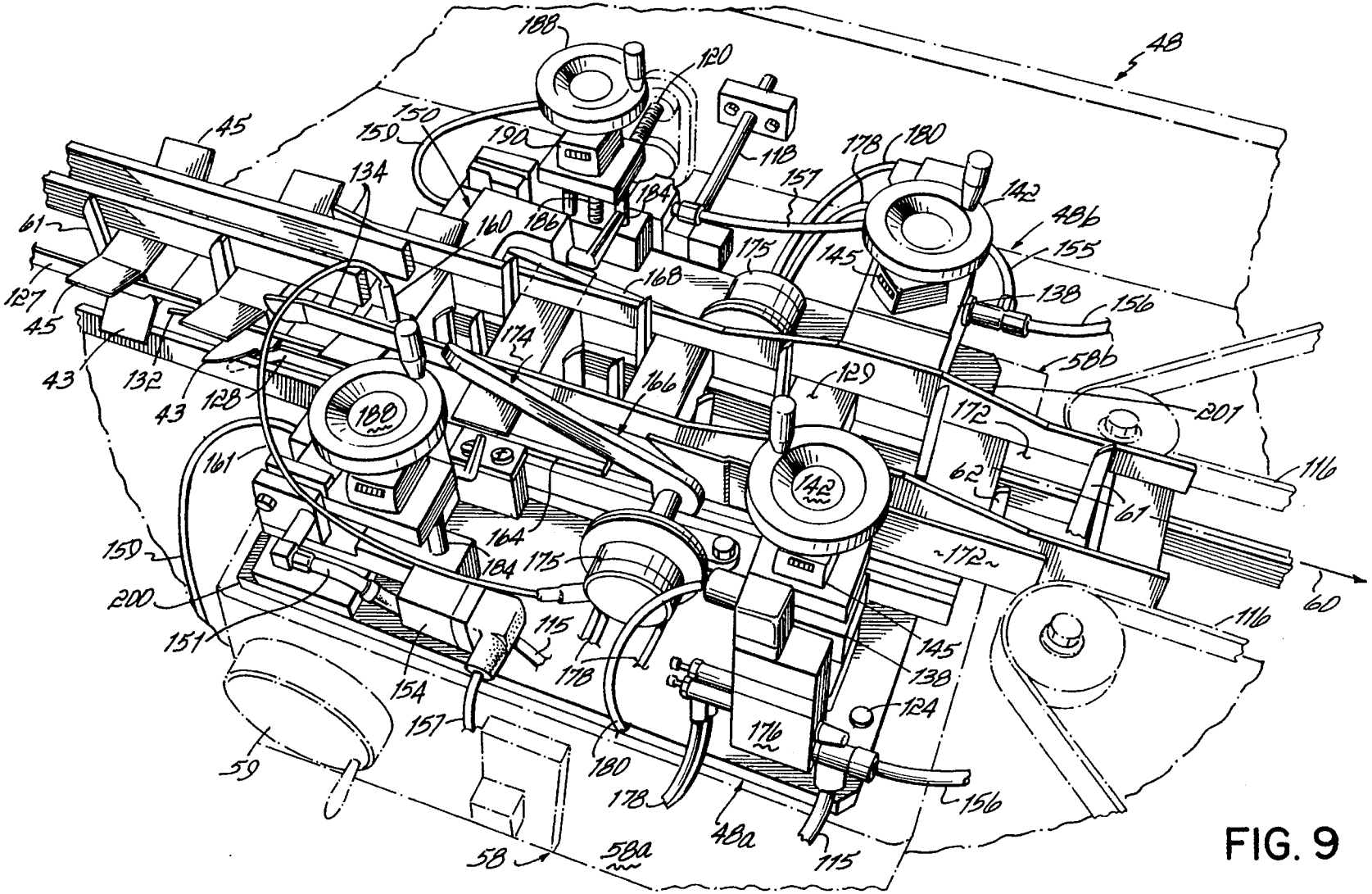
FIG. 9 is a top perspective view of the interchangeable glue module of the invention.

Turning now to FIG. 9, a glue module 48 is shown positioned along the carton path 60 of cartoner 10 at the same position along path 60 that the tuck module 46 once occupied. Similar to the tuck module 46, glue module 48 includes two opposing gluing mechanisms 48*a* and 48*b* on opposite sides of the carton path 60. Gluing mechanisms 46*a*, 46*b* are constructed and operate generally similarly except on opposite sides of the carton. Therefore, only the gluing mechanism 46*a* will be described in detail. The cartons 40 which are utilized with glue module 48 generally have four end flaps including two opposing dust flaps 42 and two opposing end flaps 43, 45 to be sealed (see FIG. 1D). As illustrated in FIG. 9, the carton 40 enter the glue module 48 on their sides with their dust flap, held closed such as by a pre-module guide 127 while the or posing end flaps to be sealed 43, and 45 remain in an open position. At the front end of glue module 48, a lower end flap guide 128 captures or engages the lower end flap 43 and directs in an upward closed position.

Figure 10:
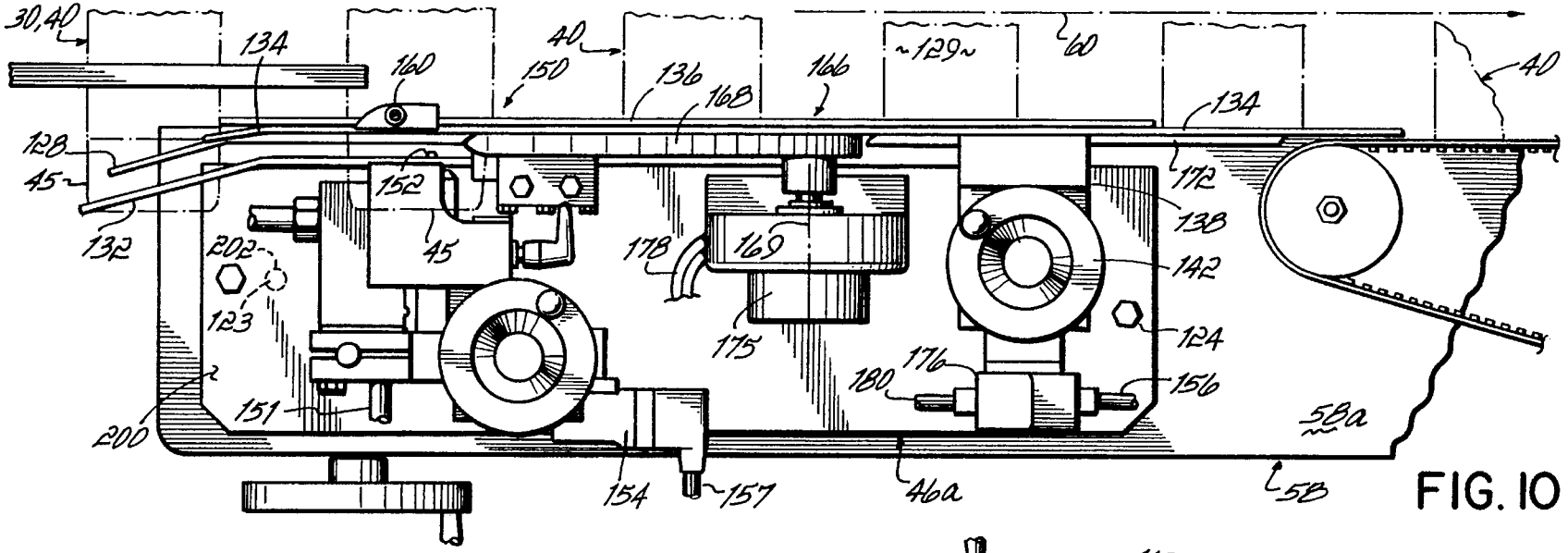
FIG. 10 is a detailed top view of a gluing mechanism of the interchangeable glue module of FIG. 9.
Figure 11:
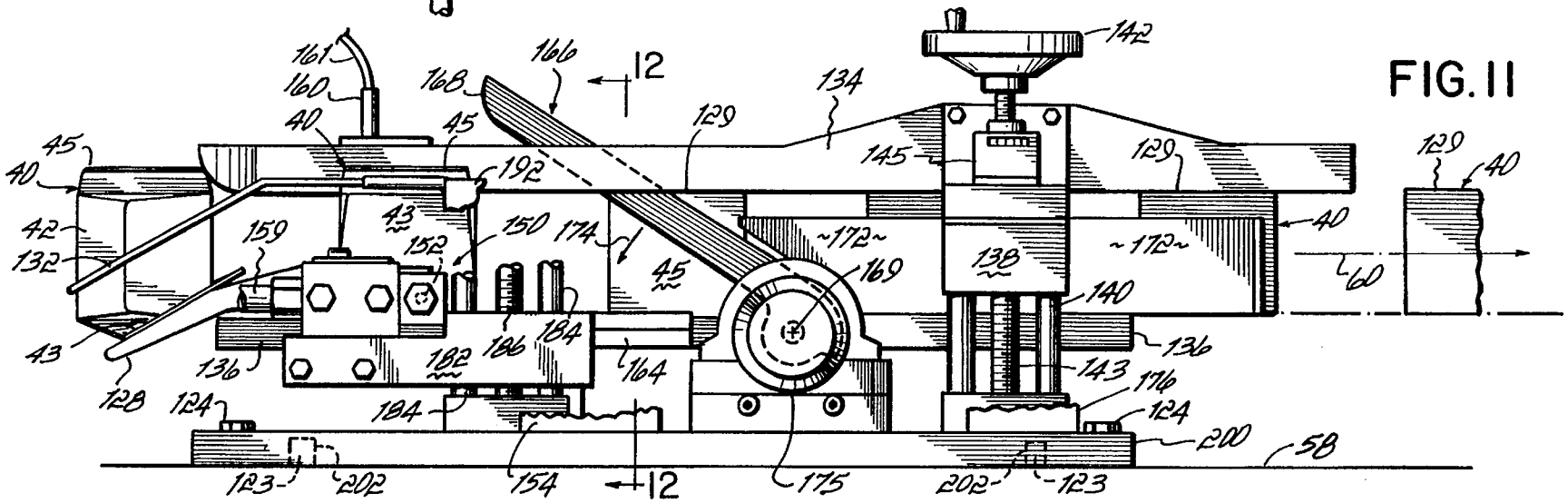
FIG. 11 is a side view, of the gluing mechanism of FIG. 10.

As illustrated in FIGS. 10 and 11, the front end of lower end flap guide 128 is angled downwardly and outwardly from the carton path 60 to smoothly capture the lower end flap 43. With the lower end flap 43 held closed, the dust flaps 42 are also held closed (See FIG. 11). An upper end flap guide 132 is also located at the front end of gluing mechanism module 48. The upper end flap guide 132 captures the upper end flap 45 and maintains it in an open position away from the end of the carton 40 so that it does not get in the way of the glue application as described further herein below. The upper end flap guide 132 is also angled downwardly and outwardly from carton path 60 to ensure a smooth capturing of the upper end flap 45. An upper carton rail 134 engages the top of the carton 129 proximate the end of the carton to insure that the carton remains in a fully erected and rectangular shape while a lower carton rail 136 supports the end of carton 40 from below. The upper rail 134 is mounted to a support 138 which is vertically movable on shafts 140 by rotation of hand wheel 142 and an adjustment screw 143. Thereby, the upper carton rail 134 may be raised and lowered with respect to carton path 60 in order to accommodate cartons of various heights. A numerical readout 145 is coupled to adjustment screw 143 and handwheel 142 and provides an accurate indication of the height of rail 134.

As shown in the FIGS. 9–12, the carton 40 enters glue module 48, the lower end flap 43 is closed by guide 128 and the upper end flap 45 is held open by guide 132. Sequentially following guides 128 and 132 along carton path 60 is a glue applicator 150 which applies glue to the closed lower end flap 43 so that upper end flap 45 may be secured to end flap 43 to seal the end of carton 40. Glue applicator 150 includes a glue nozzle 152 which is oriented to shoot toward the end of carton 40 as the carton moves through gluing mechanism 48. Nozzle 152 is pneumatically controlled and is therefore coupled to a valve 154 by line 151 (See FIG. 9) Valve 154 is connected by line 155 to a supply air line 156 which, in turn, is coupled to a supply of pressurized air (not shown). Valve 154 is also coupled to appropriate module electrical controls (not shown) by an electrical control line 157. Valve 154 and nozzle 152 are operable to apply a suitable glue, such as a hot melt adhesive, to the end panels of carton 40 to thereby seal the carton. Line 159 supplies liquid glue to nozzle 152 to be shot or sprayed therefrom.

Figure 12:
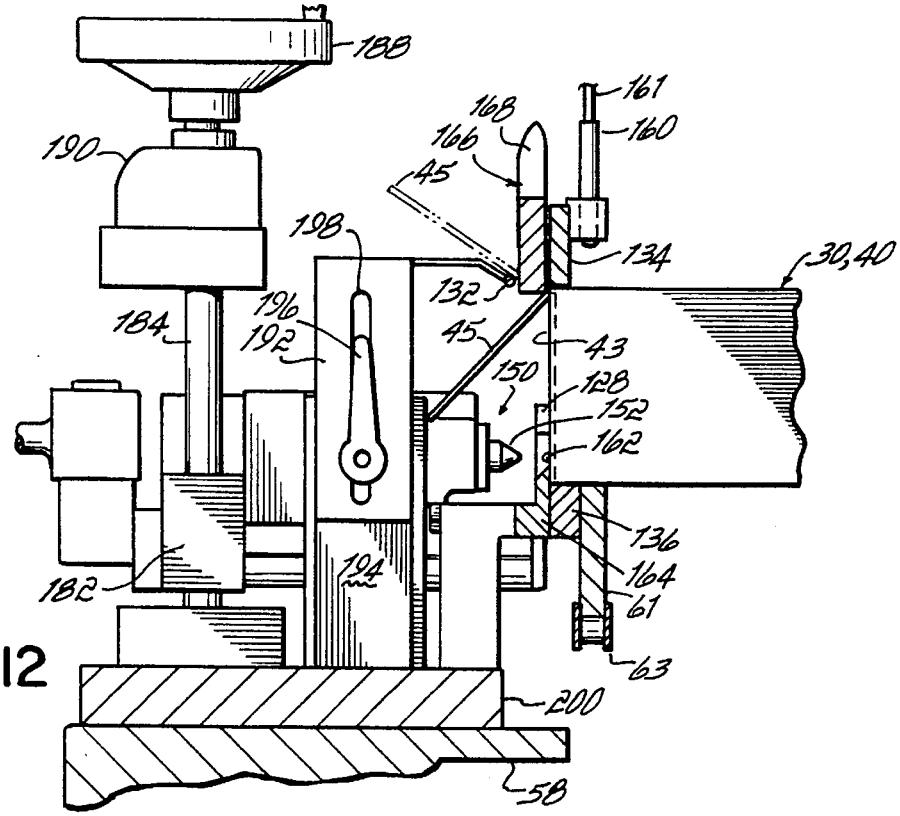
FIG. 12 is a cross-sectional view of the gluing mechanism along lines 12—12 of FIG. 11.

An optical device, such as a sensor eye 160, is mounted to the upper rail 134 in a position which is generally directly above nozzle 152 along the carton path 60. Sensor eye 160 is operably connected by line 161 to the module controls and senses the presence of the carton 40 as the carton passes by nozzle 152. Upon sensing the carton 40, the optical eye activates the valve of 154 of glue applicator 150 to shoot, spray or otherwise dispense a bead of glue 162 upon the exposed lower end flap 43 as illustrated in FIG. 12. The upper end flap 45 is held out of the spray stream of nozzle 152 during application of the glue. (See FIGS. 11 and 12). Along the carton path 60, proximate nozzle 152, the lower end flap guide 128 has a cut-away section (not shown) to expose the lower end flap 43 to nozzle 152 so that glue 162 may be applied to flap 43. To maintain the lower end flap 43 and the respective dust flaps 42 closed, a guide 164 engages the bottom of carton 40 after the carton 40 passes nozzle 152 and the end of lower flap guide 128.

In a position along carton path 60, directly past the glue nozzle 152 the upper end flap guide 132 also ends so that end flap 45 is free to hinge downwardly to seal carton 40. Carton 40 progresses past nozzle 152 and past an end flap closing mechanism or closer 166. End flap closer 166 includes an elongated closer arm 168 which is normally stationary but which may pivot vertically on an axis 169. The closer arm 168 is angled toward the front end of the glue module 48 and upwardly from the bottom of the module and module support platform 58. Closer arm 168 is also aligned in the carton path directly over the end of the carton to engage the upper end flap 45 as the carton passes the closer arm 168. The angle of the closer arm 168 gradually directs the upper end flap 45 downwardly toward the closed bottom end flap 43 and the bead of glue 162 as the carton moves along path 60. Thereby, the upper end flap 45 hinges downwardly and overlaps lower end flap 43 with glue bead 162 therebetween. Before the end of closer arm 168 along path 60, a compression guide 172 begins. Compression guide 172 is generally coplaner with closer arm 168 though it is preferably located somewhat closer to the end of the carton than arm 168. The compression guide 172 engages and presses the overlapped end flaps 45, 43 together with the glue therebetween to form a strong seal at each end of carton 40. Upon passing the compression guide 172, the carton 40 exits the glue module 48 and is carried away by the high speed belt mechanisms 50.

Oftentimes during the operation of a cartoner, it is necessary to stop the carton movement along the carton path 60, such as if there is an equipment failure or one or more cartons jam in the path 60. This presents a problem when glue has been applied to one or more cartons 40, but the end flaps 43, 45 have not yet been sealed together because they have not yet passed closer arm 168 and compression guide 172. Before the cartoner begins again, the glue may have had time to cure or harden. This may yield a weak or completely ineffective carton seal. In the past, cartons directly adjacent the glue application section of a cartoner were rejected when the cartoner again started moving in order to remove cartons with weak seals or no seals at all. The arm 168 is normally stationary. However, in accordance with the principles of the invention, the closer arm 168 is pneumatically operated by a rotating mechanism 175 to pivot downwardly from the top of the carton 40 toward the bottom of the carton, as illustrated by arrow 174, when the carton 40 ceases movement along carton path 60. The downward pivoting motion of closer arm 168 closes the end flap 45 of each carton 40 against the glue bead 162 to thereby seal the carton. The closer arm 168 is dimensional in length to engage those cartons directly adjacent the glue nozzle and preferably after the glue nozzle 152. The present invention thereby seals the stopped cartons and prevents the rejection of cartons which might otherwise have been partially sealed or not sealed at all. Closer arm 168 is pneumatically operated, therefore, rotating mechanism 175 is connected to an air valve 176 by appropriate air lines 178. Supply line 156 supplies pressurized air to valve 176 and control line 180 is coupled to the module controls (not shown) for detecting stoppage of the cartons and actuating arm 168 so that any glued but unclosed carton ends may be closed and sealed.

Referring to FIG. 11, lower end flap guide 128 and glue nozzle 152 are supported on a common support 182. Support 182 slides vertically on tracks 184 and may be moved vertically by an adjustment screw 186 which is coupled to hand wheel 188 (see FIGS. 10 and 11). By turning hand wheel 188, support 182 is moved and the height of guide 128 and nozzle 152 may be raised or lowered to accommodate cartons 40 having a variety of different heights. Generally, wheel 188 and wheel 142 would be turned in conjunction with each other to coordinate the height of rail 134 with the height of guide 128 and nozzle 152. Accordingly, wheel 188 and adjustment screw 186 are also provided with a calibrated numerical readout 190 for precisely determining the height of guide 128 and nozzle 152.

Referring the FIG. 12, the upper end flap guide 132 is also adjustably mounted for vertical movement to raise and lower the height of the guide. Guide 132 is mounted by a slotted plate 192 to a stand 194 by handle 196. Plate 192 and guide 132 are moved upwardly and downwardly by way of a slot 198 formed in plate 192. Preferably, handle 196 is threaded and may be tightened to press plate 192 against stand 194 and thereby set the height of guide 132 depending upon the height of the cartons passing through glue module 48. Similar to the tuck module 46, the gluing mechanisms **48*a* and 48*b* of glue module 48 are affixed to mounting plates 200 and 201 which may be placed on module support platform 58 and spread apart or moved closer together with respect to each other and carton path 60 to adapt to cartons of various lengths. Glue module mounting plates 200 and 201 also contain a plurality of alignment recesses or holes 202 to received upstanding alignment pins 123 on module support platform 58 such that the gluing mechanisms 48*a* and 48*b* are aligned with each other and with respect to the carton path 60. Similar bolts 124 hold the glue module mounting plates 200, 201 to the module support platform 58**.

Therefore, in accordance with the principles of the present invention, the glue module 48 may be selectively interchanged with tuck module 46 and cartoner 10 at the same position along the carton path 60. The individual tucking mechanisms **46*a* and 46*b* are removed by lifting the respective mounting plates 56A and 56B away from the carton or module support platform 58. The mounting plates 200 and 201 of the opposing gluing mechanisms of 48*a* and 48*b* of module 48 are then placed on the carton or module support platform 58 and aligned. The various adjustable guides and rails of the respective tucking or gluing mechanisms are then adjusted to handle the particular sized cartons. No further adjustment or conversion of the cartoner 10** is necessary except to connect the various pneumatic and electric control lines of the gluing mechanisms.

Each of the individual gluing and tucking mechanisms operate independently of each other. Therefore, the individual mechanisms might also be selectively interchanged without interchanging an entire module. For example, a gluing mechanism might be utilized on one side of the carton path while a tucking mechanism is utilized on the other side of the carton path. In that way, one end of the carton is glued while the other end of the carton is tucked.

The motion of the cartons through each uniquely constructed module operates various of the tucking and/or gluing steps which take place in the module. For example, movement of the carton ends and end flaps past the various rails and guides of the tucking mechanism will tuck the end flap into the end of the carton to seal the carton. The spatial relationship of the various guides and rails within each tucking or gluing mechanism provides many of the necessary steps in the tucking or gluing processes. The invention has been disclosed with respect to a module which is oriented generally horizontally on a cartoner platform with the cartons being conveyed through the modules on their sides. It will be appreciated by a person of ordinary skill in the art, that the modules might also be arranged vertically with respect to the cartoner path such that the individual gluing and tucking mechanisms are arranged as upper and lower mechanisms as opposed to side-by-side mechanisms on the carton path. Furthermore, the cartons illustrated in FIGS. 1C and 1D to be used with the interchangeable modules have end flaps which hinge upwardly or downwardly. In accordance with the principles of the present invention, a person of ordinary skill in the art may change the orientation of the various guides and rails in each tucking mechanism in order to tuck seal a carton with an end flap which hinges upwardly from the lower side as opposed to one which hinges downwardly from the upper side of the carton as shown in FIG. 1C. Furthermore, the orientations of the guides and rails in the gluing module might be adjusted by a person of ordinary skill in the art to yield a module which overlaps the upper flap with the lower flap instead of the upper flap over the lower flap as illustrated. That is, the modules might be constructed to operate in an upside down fashion compared to the modules illustrated in the figures of the application. In a further embodiment, a person of ordinary skill in the art may orient the guides and rails of each gluing or tucking mechanism to seal the ends of the carton in opposite directions. For example, one tuck flap might be hinged upwardly while the tuck flap at the other end of the carton might be hinged downwardly.

Therefore, while the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details described above. Departures may be made from such details without departing from the spirit or scope of the claims appended hereto.

What is claimed is:

1. A cartoner for loading products into cartons and for sealing the ends of product cartons as the cartons move along a carton path therein, said cartoner further comprising:

a support structure positioned proximate the cartoon path;

a tuck module mounted predominantly on a module mount, the module mount configured to be received by the support structure at a position along the carton path for the tuck module to engage an end flap of the product carton and tuck a tucking portion of the end flap into the carton end to seal the end as the carton moves along said path; and a glue module mounted predominantly on a second module mount, the second module mount selectively interchangeable with the tuck module mount at said position along the carton path for the tuck module to engage an end flap of a product carton and glue the end flap to a portion of the carton to seal the carton end as the carton moves along said path;

whereby a single cartoner may be used to seal cartons by selectively tucking or gluing the end flaps.

2. The cartoner of claim 1 wherein the tuck module comprises two opposing tucking mechanisms, the tucking mechanisms positioned on opposite sides of the carton path for engaging end flaps at opposite ends of the carton and tucking the flaps to seal both ends of the carton.

3. The cartoner of claim 1 wherein the glue module comprises two opposing gluing mechanisms, the gluing mechanisms positioned on opposite sides the carton path for engaging end flaps at opposite ends of the carton and gluing the flaps to the carton to seal both ends of the carton.

4. The cartoner of claim 1, wherein the tuck module comprises an end flap guide positioned along the carton path for directing the end flap toward the carton and over a folding guide as the carton moves along said path.

5. The cartoner of claim 4 wherein the tuck module further comprises a tuck flap guide, sequentially following the end flap guide along the path, for folding a portion of the end flap over the folding guide to create a tuck flap on the end flap to tuck inside the end of the carton.

6. The cartoner of claim 1 wherein the tuck module comprises a tucking device for engaging the end flap as the carton moves along the carton path and gradually shoving a tucking portion of the end flap into the end of the carton.

7. The cartoner of claim 6 wherein the tuck module includes a rotating belt moving generally in the direction of the control path and being angled with respect to the carton path for gradually shoving the tucking portion into the end of the carton.

8. The cartoner of claim 1 wherein the tuck module further comprises a locking roller rotating in the direction of the carton path for engaging the end of the carton proximate the tucking portion of the end flap to insure that the tucking portion is securely tucked as the carton moves along said path.

9. The cartoner of claim 1 wherein each of the tuck and glue modules comprise a carton rail for engaging the end of the carton and holding carton end flaps in a closed position when another end flap is being one of tucked into or glued to the carton.

10. The cartoner of claim 1 wherein the glue module comprises an end flap guide for lifting the end flap away from the carton end and exposing the carton end to receive glue to secure the end flap to the carton.

11. The cartoner of claim 1 wherein the glue module comprises an end flap guide for directing a second end flap toward the carton such that the first end flap may be glued to the second end flap to seal the carton end.

12. The cartoner of claim 1 wherein the glue module comprises a glue applicator positioned along the carton path for applying glue to a portion of the carton such that the end flap may be glued to the carton.

13. The cartoner of claim 12 wherein the glue module further comprises an optical device electrically coupled to the glue applicator, the optical device operable for detecting the presence of a carton and activating the glue applicator to apply glue to a carton.

14. The cartoner of claim 1 wherein the glue module is operable to apply glue to a portion of the carton and comprises an end flap closer positioned in the carton path for engaging the end flap and directing the end flap into a closed position in contact with the carton portion carrying the glue.

15. The cartoner of claim 14 wherein the end flap closer includes an elongated guide which is angled with respect to the carton path to engage the end flap and gradually direct the end flap to the closed position.

16. The cartoner of claim 14 wherein the end flap closer if movable and is operable to contact the end flap and move the end flap into a closed position when the cartons cease their movement along the carton path through the module whereby a carton with glue recently applied between the carton and end flap may be sealed to prevent loss of the carton seal.

17. The cartoner of claim 14 wherein the glue module further comprises a compression guide sequentially following the end flap closer on the carton path for pressing the closed end flap against the carton and glue to ensure a proper carton glue seal.

18. The cartoner of claim 1 further comprising an alignment structure positioned at the module position on the carton path, each of the tuck and glue modules including an engaging portion for engaging said alignment structure to properly position one of said modules on the cartoner in alignment with the carton path.

19. The cartoner of claim 18 wherein the alignment structure includes an upstanding pin and the module engaging portion includes a recess to receive said pin and align the module with the carton path.

20. The cartoner of claim 1 wherein the tuck and glue modules each include opposing mechanisms positioned on opposite sides of the carton path, the cartoner further comprising a platform to hold the mechanisms which is separable for moving the mechanisms apart from each other on the path to adapt the cartoner to cartons of various lengths.

21. The cartoner of claim 1 wherein the support structure includes a platform for receiving the module mount.

22. The cartoner of claim 21 wherein the support structure further includes an alignment structure for engaging the module mount to properly position one of said modules along the carton path.

23. A cartoner for loading products into cartons and for sealing both ends of a product carton as the cartons move along a carton path therein, said cartoner further comprising:

a support structure positioned proximate the carton path;

a tucking mechanism mounted predominantly on a module mount configured to be received by the support structure adjacent a side of the carton path, the tucking mechanism for engaging an end flap at an end of a product carton and tucking a portion of said end flap into the carton end to seal the end as the carton moves along said path;

a gluing mechanism mounted predominantly on a second module mount configured to be received by the support structure adjacent a side of the carton path and opposite the tucking mechanism, the gluing mechanism for engaging another end flap at the other carton end and gluing said other end flap to a portion of the carton to seal the carton end as the carton moves along said path;

a second tucking mechanism, mounted predominantly on a module mount and selectively interchangeable with the first gluing mechanism and associated module mount, for engaging a carton end flap and tucking the end flap into the carton such that the carton may be selectively sealed at both ends by tucking; and a second gluing mechanism, mounted predominantly on a module mount and selectively interchangeable with the first tucking mechanism and associated module mount, for engaging a carton end flap and gluing the end flap to the carton such that the carton may be selectively sealed at both ends by gluing;

whereby a single cartoner may be used to seal cartons by selectively tucking or gluing the end flaps of a carton.

24. The cartoner of claim 23 wherein at least one of said tucking mechanisms comprises an end flap guide positioned along the carton path for directing the end flap toward the carton and over a folding guide as the carton moves along said path.

25. The cartoner of claim 24 wherein at least one of said tucking mechanisms comprises a tuck flap guide, sequentially following the end flap guide along the path, for folding a portion of the end flap over the folding guide to create a tuck flap on the end flap to tuck inside the end of the carton.

26. The cartoner of claim 25 wherein the support structure includes a platform for receiving the module mount.

27. The cartoner of claim 23 wherein at least one of said tucking mechanisms comprises a tucking device for engaging the end flap as the carton moves along the carton path and gradually shoving a tucking portion of the end flap into the end of the carton.

28. The cartoner of claim 23 wherein at least one of said gluing mechanisms comprises an end flap guide for lifting the end flap away from the carton end and exposing the carton end to receive glue to secure the end flap to the carton.

29. The cartoner of claim 23 wherein at least one of said gluing mechanisms comprises an end flap guide for directing a second end flap toward the carton such that the first end flap may be glued to the second end flap to seal the carton end.

30. The cartoner of claim 23 wherein at least one of said gluing mechanisms comprises a glue applicator positioned along the carton path for applying glue to a portion of the carton such that the end flap may be glued to the carton.

31. The cartoner of claim 23 wherein at least one of said gluing mechanisms is operable to apply glue to a portion of the carton and comprises an end flap closer positioned in the carton path for engaging the end flap and directing the end flap into a closed position in contact with the carton portion carrying the glue.

32. The cartoner of claim 23 wherein the end flap closer is movable and is operable to contact the end flap and move the end flap into a closed position when the cartons cease their movement along the carton path through the module whereby a carton with glue recently applied between the carton and end flap may be sealed to prevent loss of the carton seal.

33. A cartoner for loading products into cartons and for sealing the ends of product cartons as the cartons move along a carton path therein, said cartoner further comprising:

a support platform positioned on the cartoner transverse to the carton path;

a tuck module plate and a tucking mechanism mounted on said tuck module plate along a side thereof, the plate configured to be received by said platform at a side of the carton path with said plate side generally parallel the carton path and the tucking mechanism operable to engage an end flap of the carton and tuck a portion of the end flap into the carton to seal the carton end as the carton moves along the path past the tuck module;

a glue module plate and a gluing mechanism mounted on said glue module plate along a side thereof, the glue module plate being selectively interchangeable with the tuck module plate and the gluing mechanism operable to engage an end flap of a product carton and glue the end flap to a portion of the carton to seal the carton end as the carton moves along said path past the glue module;

whereby a single cartoner may be used to seal cartons by selectively tucking or gluing the end flaps.

34. The cartoner of claim 33, further comprising a second module plate and a second tucking mechanism mounted along a side of said second plate, said second plate configured to be received by said platform at a side of the carton path opposite the first tucking mechanism and operable to engage and tuck a portion of an end flap into the carton and seal another end of the carton;

whereby both sides of a carton may be sealed by tucking the end flaps.

35. The cartoner of claim 33 further comprising a second module plate and a second gluing mechanism mounted along a side of said second plate, said second plate configured to be received by said platform at a side of the carton path opposite the first gluing mechanism and operable to engage and glue a portion of an end flap to the carton and seal another end of the carton;

whereby both sides of a carton may be sealed by gluing the end flaps.

36. The cartoner of claim 33 wherein a section of said platform receiving the module plates is movable with respect to the carton path for moving the plates and respective mechanisms toward and away from said path to accommodate cartons of various lengths.

37. A cartoner for loading products into cartons and for sealing the ends of product cartons as the cartons move along a carton path therein, said cartoner comprising:

a tuck module for sealing the end of a product carton and mounted predominantly on a module mount;

a module support located at a position on the cartoner along the carton path, said module support configured to receive and support said module mount and tuck module which is operable for engaging an end flap of the product carton and tucking a tucking portion of the end flap into the carton and to seal the end as the carton moves along said path;

said module mount and tuck module being removable from said module support and said module support further being adapted for receiving another sealing module and associated module mount for operating on an end of a product carton to seal said carton end.

38. A cartoner for loading products into cartons and for sealing the ends of product cartons as the cartons move along a carton path therein, said cartoner comprising:

a glue module for sealing the end of a product carton and mounted predominantly on a module mount;

a module support located at a position on the cartoner along the carton path, said module support configured to receive and support said module mount and glue module which is operable for engaging an end flap of a product carton and gluing the end flap to a portion of the carton to seal the carton end as the carton moves along said path;

said module mount and glue module being movable from said module support and said module support further being adapted for receiving another sealing module and associated module mount for operating on an end of a product carton to seal said carton end.

* * * * *

UNITED STATES PATENT AND TRADEMARK OFFICE

CERTIFICATE OF CORRECTION

PATENT NO. : 5,595,043

DATED : January 21, 1997

INVENTOR(S) :

Richard E. Radigan

It is certified that error appears in the above-identified patent and that said Letters Patent is hereby corrected as shown below:

Column 8, line 45, delete "if fully inserted", and insert --is fully inserted--.

Column 8, line 55, delete "in runt", and insert --in turn--.

Column 8, line 56, delete "has to", and insert --has two--.

Column 8, line 65, delete "51a, 58b" and insert --58a, 58b--.

Column 9, line 22, delete "carton 40" and insert --cartons 40--.

Column 9, line 23, delete "dust flap" and insert --dust flaps--.

Column 9, line 24, delete "while the or posing" and insert --while the opposing--.

Column 9, line 27, delete "directs in" and insert --directs it in--.

Column 12, line 60, delete "cartoon path" and insert --carton path--.

Column 11, line 30, delete "referring the" and insert --referring to the--.

Column 14, line 9, delete "if movable" and insert --is movable--.

Signed and Sealed this

Second Day of December, 1997

*Attest:*

Bruce Lehman

BRUCE LEHMAN

*Attesting Officer*

*Commissioner of Patents and Trademarks*